United States Patent [19]

Kato et al.

[11] 4,144,864

[45] Mar. 20, 1979

[54] METHOD AND APPARATUS FOR DISABLING CYLINDERS UNDER LIGHT LOAD CONDITIONS BY COMPARISON WITH VARIABLE REFERENCE

[75] Inventors: Fumiaki Kato, Yokohama; Haruhiko Iizuka; Junichiro Matsumoto, both of Yokosuka, all of Japan

[73] Assignee: Nissan Motor Company, Limited, Japan

[21] Appl. No.: 801,415

[22] Filed: May 27, 1977

[30] Foreign Application Priority Data

May 31, 1976 [JP] Japan ..... 51-62287

[51] Int. Cl.[2] ..... F02D 13/06; F02B 3/00

[52] U.S. Cl. ..... 123/198 F; 123/32 EA; 123/32 EH; 123/32 EL

[58] Field of Search ..... 123/198 F, 32 EA, 32 EB, 123/32 EC, 32 EH, 32 EL

[56] References Cited

U.S. PATENT DOCUMENTS

| | | | |
|---|---|---|---|
| 2,652,038 | 9/1953 | Winkler | 123/198 F |
| 2,875,742 | 3/1959 | Dolza | 123/198 F X |
| 3,756,205 | 9/1973 | Frost | 123/198 F X |
| 3,896,779 | 7/1975 | Omori et al. | 123/32 EA X |
| 3,898,963 | 8/1975 | Twata et al. | 123/32 EA |
| 4,061,055 | 12/1977 | Lizuka et al. | 123/198 F X |
| 4,064,844 | 12/1977 | Matsumoto et al. | 123/198 F X |

*Primary Examiner*—Ira S. Lazarus

[57] ABSTRACT

In an internal combustion engine, the magnitude of the engine load is compared with a reference level which is variable as a function of engine speed to detect when the engine load under low speed operation is small in proportion to the engine speed. Under these circumstances, fuel supply to a portion of the cylinders is blocked to allow the engine to run on a lesser number of cylinders so that fuel economy is achieved.

6 Claims, 6 Drawing Figures

METHOD AND APPARATUS FOR DISABLING CYLINDERS UNDER LIGHT LOAD CONDITIONS BY COMPARISON WITH VARIABLE REFERENCE

FIELD OF THE INVENTION

The present invention relates to method and apparatus for operating an internal combustion engine on cylinders of reduced number under light load condition to provide fuel economy, while operating it on full cylinders under heavy load condition to provide power.

BACKGROUND OF THE INVENTION

Internal combustion engines are conventionally operated on full cylinders regardless of the magnitude of the engine load and it is the mixture ratio of air to fuel supplied to the engine that determines the power necessary for the vehicle. However, from the fuel economy standpoint it is unsatisfactory to operate an engine on full cylinders under light load or cruising drive.

Since electronic fuel injection is capable of providing accurate proportioning of air-fuel mixture for each cylinder in response to engine operating parameters, it is advantageous to utilize the capability of the electronic fuel injection to switch the operating mode of the engine cylinders in response to the varying engine loads.

Copending U.S. Pat. application No. 724,082 filed on Sept. 16, 1976 now patent No. 4,064,844 discloses a system which permits the engine to run on full cylinder operation until the vehicle speed rises above approximately 30 kilometers per hour. Although the full cylinder operation during low speed drive avoids undesirable engine vibration which could become appreciable if the engine should run on three cylinders at lower speed level, the fuel cut-off range is only limited to highway drive.

SUMMARY OF THE INVENTION

An object of the present invention is to achieve fuel economy for internal combustion engines during low speed operation by cutting off fuel supply to part of the cylinders when engine load is relatively small in relation with vehicle speed.

Another object of the invention is to provide method and apparatus in which engine load is compared with a reference threshold to determine when the engine load is relatively small in comparison with the engine speed. The reference threshold is variable as a function of the engine speed so that the threshold is low at low engine speed and increases therewith until it reaches a medium speed level. When the engine load is below the variable threshold with the engine running at low speed, fuel supply is cut off to part of the cylinders so that the engine runs on the rest of the cylinders.

In accordance with the invention, an internal combustion engine is provided with a load sensor and an engine speed sensor. Function generators are connected to the speed sensor to provide an output from each of the generators. The output from one of the function generators has a nonlinear characteristic as a function of the engine speed and the output from the other function generator has a similar nonlinear characteristic with the amplitude lower than the amplitude of the output from the first-mentioned function generator. Specifically, each output increases as the engine speed increases until it reaches medium speed. The outputs from these function generators are applied to first and second comparators, respectively, as high and low threshold levels for comparison with the sensed engine load. When the engine load is below the lower threshold level, an output is delivered from the respective comparator to a logic control circuit which disables a predetermined number of cylinders, and when the engine load lies between the high and low threshold level the working cylinders are maintained in the same condition as in the previous operational mode. When the engine load rises above the higher threshold level, the logic circuit switches the operational mode so that active cylinders are increased to give more power.

BRIEF DESCRIPTION OF THE DRAWINGS

These and other objects, features and advantages of the present invention will be understood from the following description when read in conjunction with the accompanying drawings, in which.

DESCRIPTION OF THE PREFERRED EMBODIMENTS

Figure 1:
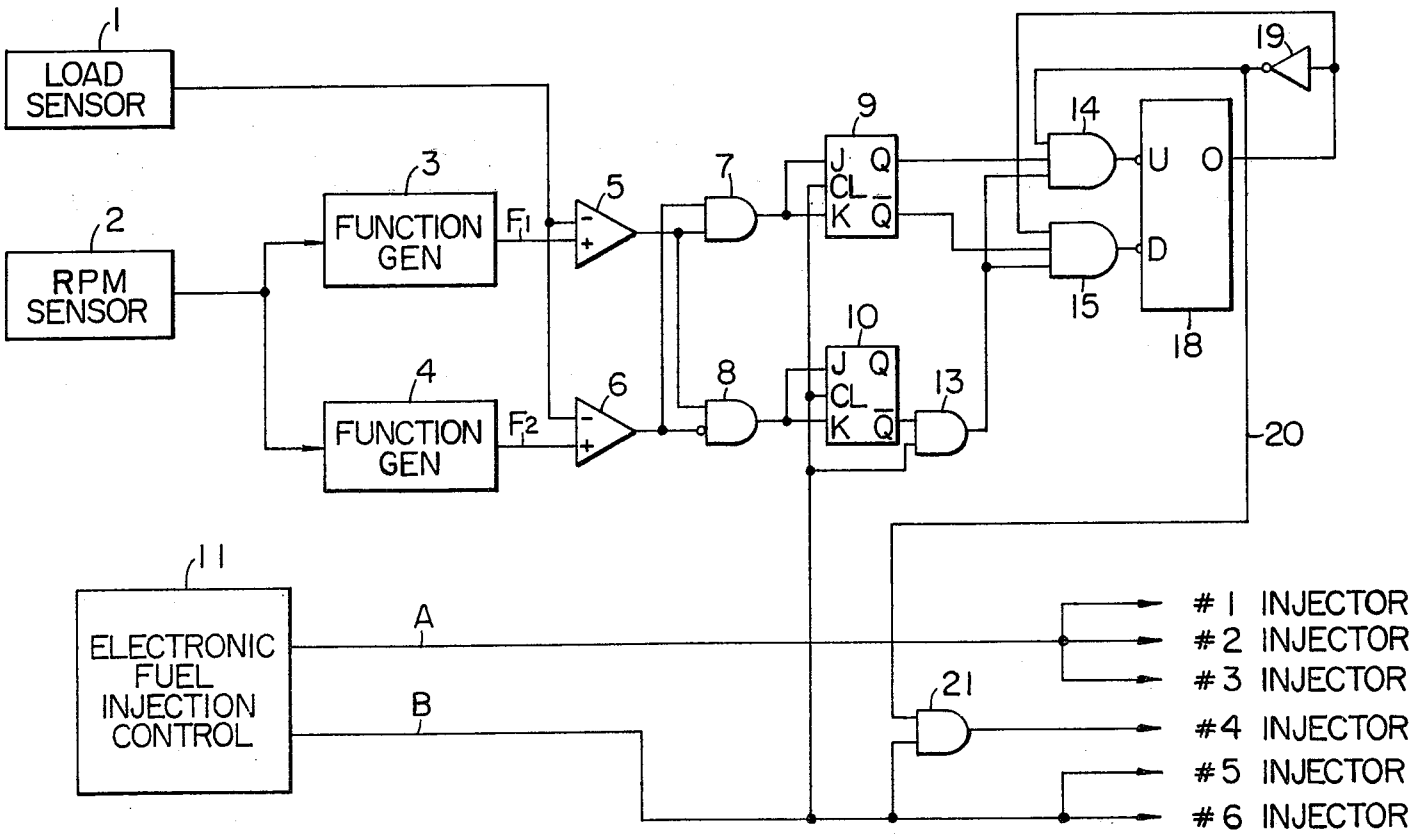
FIG. 1 is an embodiment of the present invention.
Figure 2:
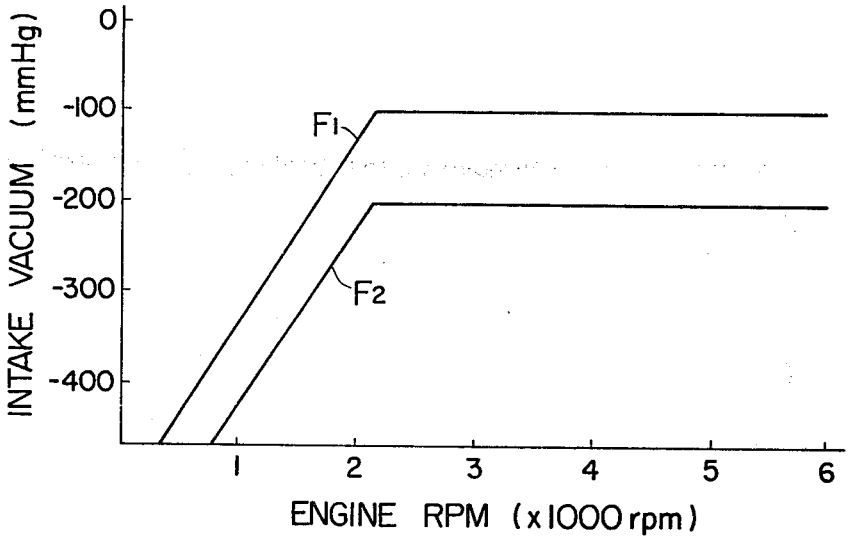
FIG. 2 is a graphic representation of the nonlinear output characteristic of function generators used in the embodiment of FIG. 1.

Referring now to FIG. 1, an electronic fuel injection system embodying the invention is illustrated. A load sensor 1 is provided to detect the pressure depression in the intake manifold, or air-flow volume per unit revolution of the engine, to provide a signal which represents the magnitude of the detected engine load to an inverting input of comparators 5 and 6. The engine RPM is detected by a sensor 2 and the signal representing the engine RPM is applied to function generators 3 and 4. The function generator 3 is designed to provide an output whose amplitude has a characteristic change as a function of the input signal. As indicated by the curve $F_1$ of FIG. 2, the output from the function generator 3 increases linearly as the engine RPM increases and levels off when the engine reaches approximately 2000 RPM. The output from the function generator 3 corresponds to the intake vacuum (mm Hg) so that it represents a variable reference level with which the input variable sensed by the load sensor 1 is compared. Therefore, the engine load is compared with a lower reference level until 2000 RPM is reached than when the engine RPM exceeds that speed level. The function generator 4 is designed to provide an output characteristic curve as indicated by curve $F_2$, which is similar to the curve $F_1$ except that the level of the output is lower than the curve $F_1$, so that the voltage delivered from the function generator 3 when the engine RPM is 3000 corresponds to an intake vacuum pressure of −100 mm Hg whereas the voltage delivered from the function generator 4 corresponds to an intake vacuum pressure of −200 mm Hg. Therefore, the difference in output voltage between function generators 3 and 4 corresponds to a difference in vacuum pressure of 100 mm Hg.

The outputs from the function generators 3 and 4 are connected to the noninverting of the comparators 5 and 6, respectively, for comparison with the sensed engine load. Comparator 5 provides a high voltage level output when the engine load is lower than the reference setting level determined by the function generator 3 and a low voltage level output when the situation is reversed. Similarly, comparator 6 provides a high voltage level output when the engine load is lower than the reference setting level determined by the function generator 4 and a low voltage level output when the situation is reversed.

The outputs from the comparators 5 and 6 are both at the high voltage level or "1" logic state when the engine load as represented by intake vacuum is lower than the setting level determined by the curve $F_2$ of function generator 4 and both at the lower voltage level or "0" logic state when the engine load is higher than the setting level determined by the curve $F_1$ of function generator 3.

When the engine load lies between the levels set by function generators 3 and 4, comparator 5 output is "1" while comparator 6 output is "0" so that AND gate 8 is activated.

The engine is assumed to have been started at time $t_0$ (see FIG. 3) and the engine load is higher than the reference level $F_1$ until time $t_1$. During this time interval, comparators 5 and 6 provide "0" output so that AND gates 7 and 8 remain in the low or "0" output state (FIGS. 3*d* to 3*g*).

The outputs from the AND gates 7 and 8 are connected to the J and K input terminals of flip-flops 9 and 10, respectively. Flip-flops 9 and 10 are both synchronized with a clock signal supplied to their clock terminals CL from an electronic fuel injection control unit 11. This clock signal is also used as a fuel injection signal for the fuel injectors No. 4, No. 5 and No. 6 so that they are ignited at the same timed intervals, while the injectors No. 1, No. 2, and No. 3 are activated simultaneously with different timing from the injectors No. 4 to No. 6. The injection pulses supplied to the No. 1 to No. 3 injectors are termed injection signal A and those supplied to the No. 4 to No. 6 injectors are termed injection signal B and both signals are supplied from the control unit 11 (FIGS. 3*b*, 3*c*).

During the time interval $t_0$ to $t_1$, flip-flops 9 and 10 remain in the same logic state and provide high voltage level $\overline{Q}$ outputs (FIGS. 3*h* and 3*i*). The $\overline{Q}$ outputs of flip-flops 9 and 10 are connected to AND gates 15 and 13, respectively. AND gate 13, when enabled by the $\overline{Q}$ output from the flip-flop 10, passes the clock signal to AND gates 14 and 15, and thence to the up- and down-count terminals of an up-down or forward-backward counter 18, respectively. The output of the counter 18 is coupled to the AND gate 15 and the inverted output of the counter 18 by means of an inverter 19 is coupled to the AND gate 14 and also over lead 20 to an AND gate 21 to which is also applied the clock or injection signal B. The output from the AND gate 21 is connected to the No. 4 injector.

With the $\overline{Q}$ output of flip-flop 10 being at the "1" logic state, AND gate 13 is enabled to pass the clock pulses to AND gates 14 and 15. During this initial time period $t_0$ to $t_1$, the output from the forward-backward counter 18 is still in the "0" logic level and thus AND gates 14 and 15 are in the "0" logic state and AND gate 21 is enabled so that all the injectors are supplied with injection control signals. Therefore, it should be understood that when the engine load is above the higher setting level $F_1$ during the initial starting period, i.e. when the engine is operating under heavy load condition with its crankshaft revolution relatively low, all the cylinders of the engine are brought into full operation to give maximum output power.

When the engine load falls below the setting level $F_1$, but lies above the lower setting level $F_2$ at time $t_1$, comparator 5 is switched to the high output state while comparator 6 remains in its low output state, resulting in the AND gate 8 providing a "1" output. With AND gate 8 being switched to "1", clock pulse B1 that occurs immediately after time $t_1$ causes flip-flop 10 to change the binary state of its Q output to "0", disabling AND gate 13.

At time $t_2$ the engine load falls below the lower setting level $F_2$ and consequently comparator 6 is switched to the high output state. The output of AND gate 7 goes high and that of AND gate 8 goes low. Clock pulse B2 that occurs immediately after time $t_2$ changes the binary state of flip-flops 9 and 10. AND gates 13 and 14 are thus enabled and clock pulse B3 which occurs subsequent to pulse B2 is applied to the up-count input of counter 18 with the result that the output thereof goes high at time $t_3$. With the counter output being at the "1" logic state, AND gate 14 is disabled to prevent the application of subsequent clock pulses to the up-count input, and the AND gate 21 is disabled. Therefore, during the time interval $t_1$ to $t_3$ the 6-cylinder ignition mode is maintained.

From time $t_2$ onward the engine runs under light load condition with its crankshaft revolution relatively high, No. 4 injector is disabled and the vehicle runs on five cylinders.

It is assumed that the vehicle speed has decelerated after time $t_3$ and accelerated again at time $t_4$ so that the vehicle speed or RPM is relatively low in comparison with the engine load. With the engine load exceeding the lower setting level $F_2$ at time $t_4$, the comparator 6 output goes low and AND gate 8 provides "1" output. Clock pulse B4 occurring after time $t_4$ switches the flip-flop 10 so that its $\overline{Q}$ output goes low. As a result AND gate 13 is disabled.

At time $t_5$ the engine load exceeds the higher setting level $F_1$ to enable the comparator 5 to be switched to the low output state and AND gates 7 and 8 are also switched to the "0" logic state. Clock pulse B5 subsequent to time $t_5$ switches the flip-flops 9 and 10 so that their $\overline{Q}$ outputs assume a high voltage level, causing AND gate 13 to be enabled. Since the output state of the counter 18 is in the "1" logic state, AND gate 15 is also enabled and a subsequent clock pulse B6 is applied to the down-count input of the counter 18, so that the output of the counter 18 changes to the "0" state at time $t_6$. This enables AND gate 21 so that the engine's operational mode is again switched to the 6-cylinder mode at time $t_6'$ in response to the subsequent injection pulse B7.

During time interval $t_6$ to $t_7$, engine load is above the higher setting level $F_1$ and during interval $t_7$ to $t_8$ it lies between the high and low setting levels as during the interval $t_1$ to $t_2$. The engine runs on six cylinders until time $t_9$. As the engine runs at low city traffic speeds the outputs from the function generators 3 and 4 gradually decrease as illustrated in FIG. 3A-*a*, and if the engine load is assumed to decrease below the decreasing lower threshold lever $F_2$ as illustrated, the No. 4 cylinder injector is disabled at time $t_9$ and the engine runs on five cylinders from then on.

Flip-flops 9 and 10 are designed to change their binary state in response to the trailing edge of the injection pulse. This guarantees against the generation of injection pulses having different pulse duration from that determined by the electronic fuel injection control unit 11.

Figure 4:
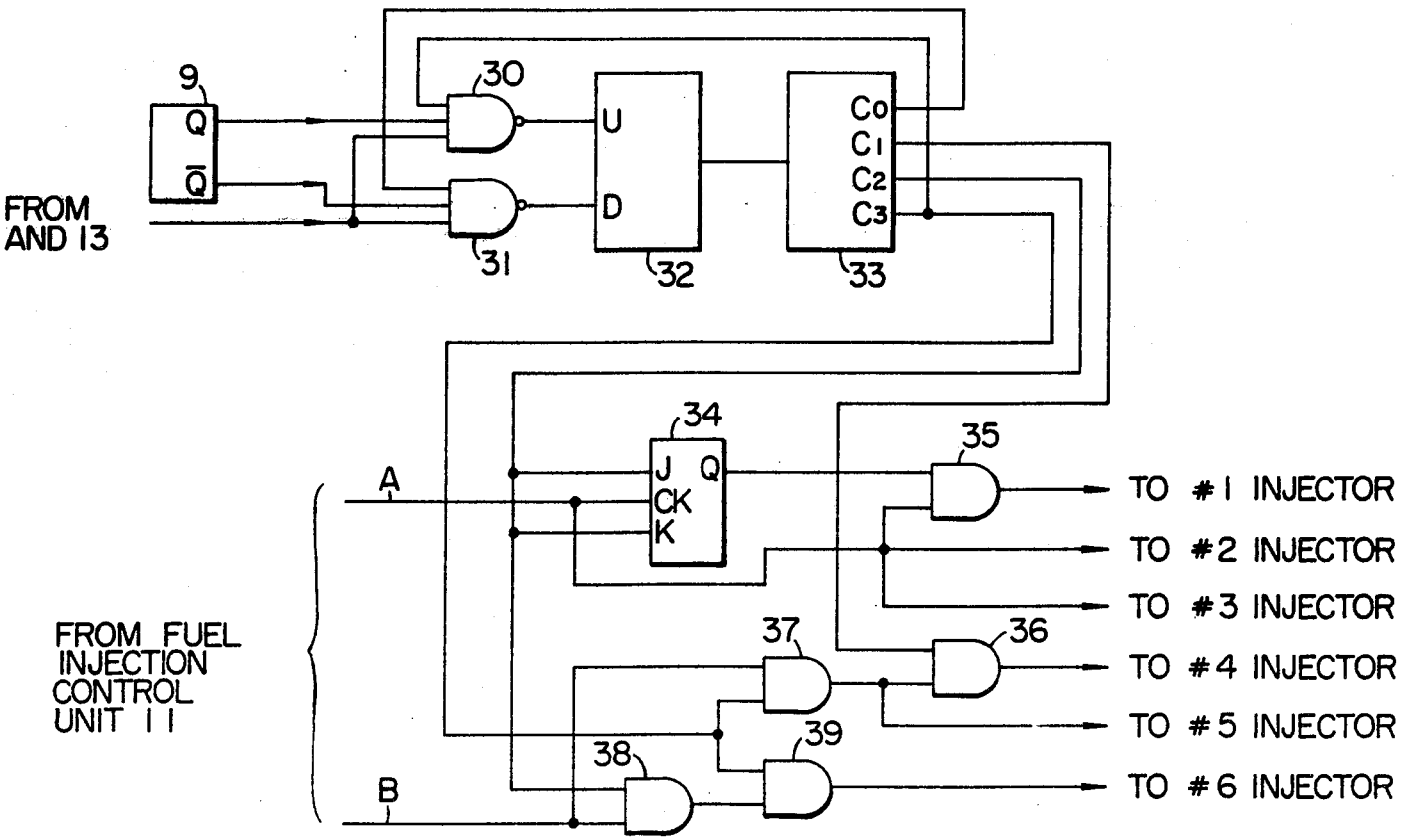
FIG. 4 is a modification of the embodiment of FIG. 1.

A modification of the previous embodiment is shown in FIG. 4 in which the maximum number of disabled cylinders is three instead of one and disabling is effected on a one-cylinder-at-a-time basis in step with successive injection pulses. In the modification of FIG. 4 identical parts to those shown in FIG. 1 are omitted for the sake of simplicity, only the modified parts being illustrated. The Q and $\overline{Q}$ outputs of the flip-flop 9 are connected to AND gates 30 and 31, respectively, to which is also connected the output from AND gate 13 for application of clock or injection signal B to forward-backward counter 32. The output of the counter 32 is connected to a decoder 33 having $C_0$, $C_1$, $C_2$ and $C_3$ output leads. The output lead $C_0$ is connected to AND gate 31, and $C_3$ to AND gate 30 and to AND gates 37 and 39. The output lead $C_1$ is in turn connected to an AND gate 36, the lead $C_2$ being connected to the J and K inputs of a flip-flop 34 and to an AND gate 38.

When the engine is started and its load is above the higher setting level $F_1$, the decoder 33 provides a low level output on lead $C_0$ and a high level output on leads $C_1$ to $C_3$, causing AND gates 30 and 31 to be disabled. Under these circumstances, flip-flop 34 is switched to provide a high Q output to AND gate 35, and AND gates 36 to 39 are all enabled so that all the cylinders are activated.

Figure 3:
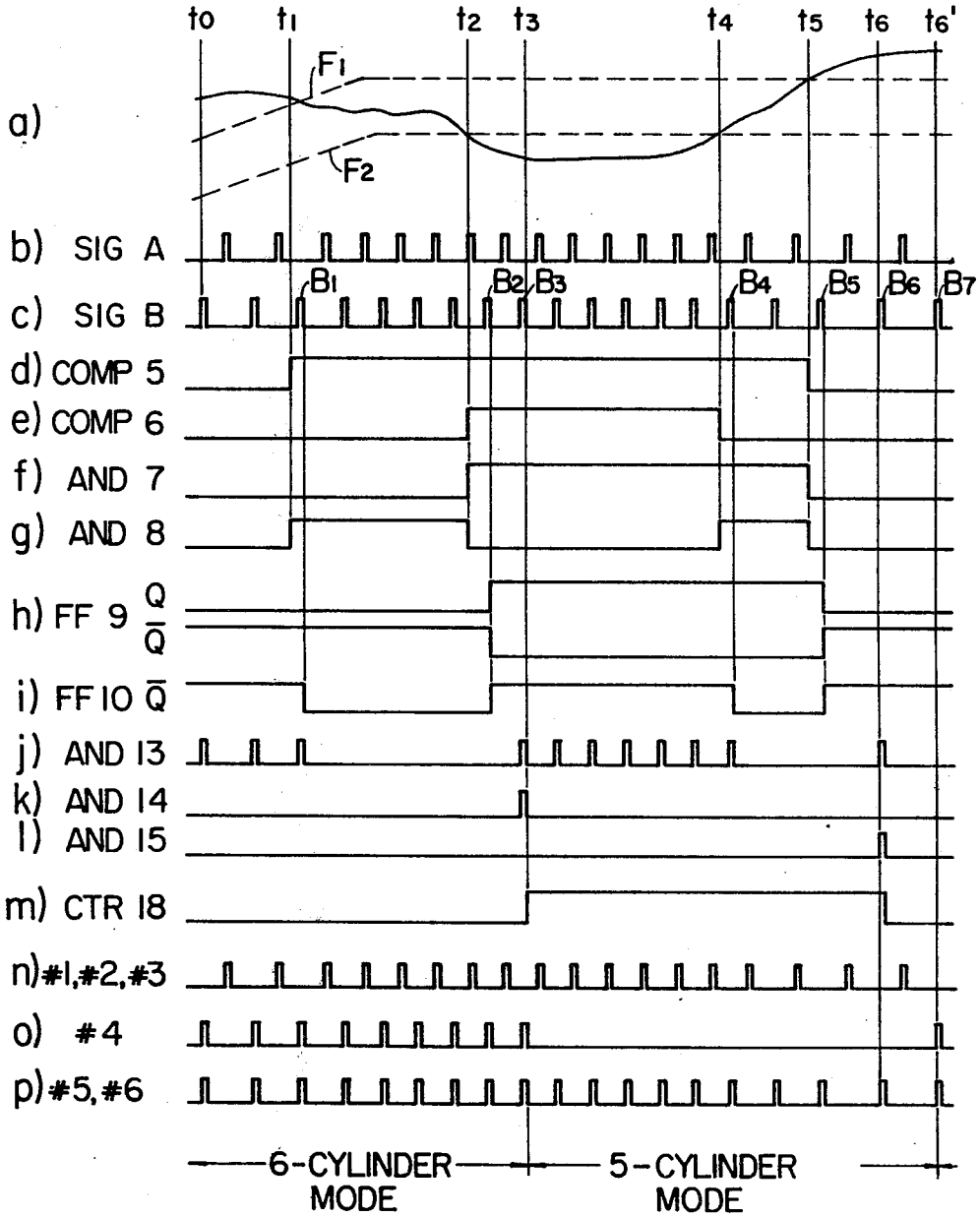
FIGS. 3 and 3A are timing diagrams useful for describing the operation of the embodiment of FIG. 1.
Figure 3A:
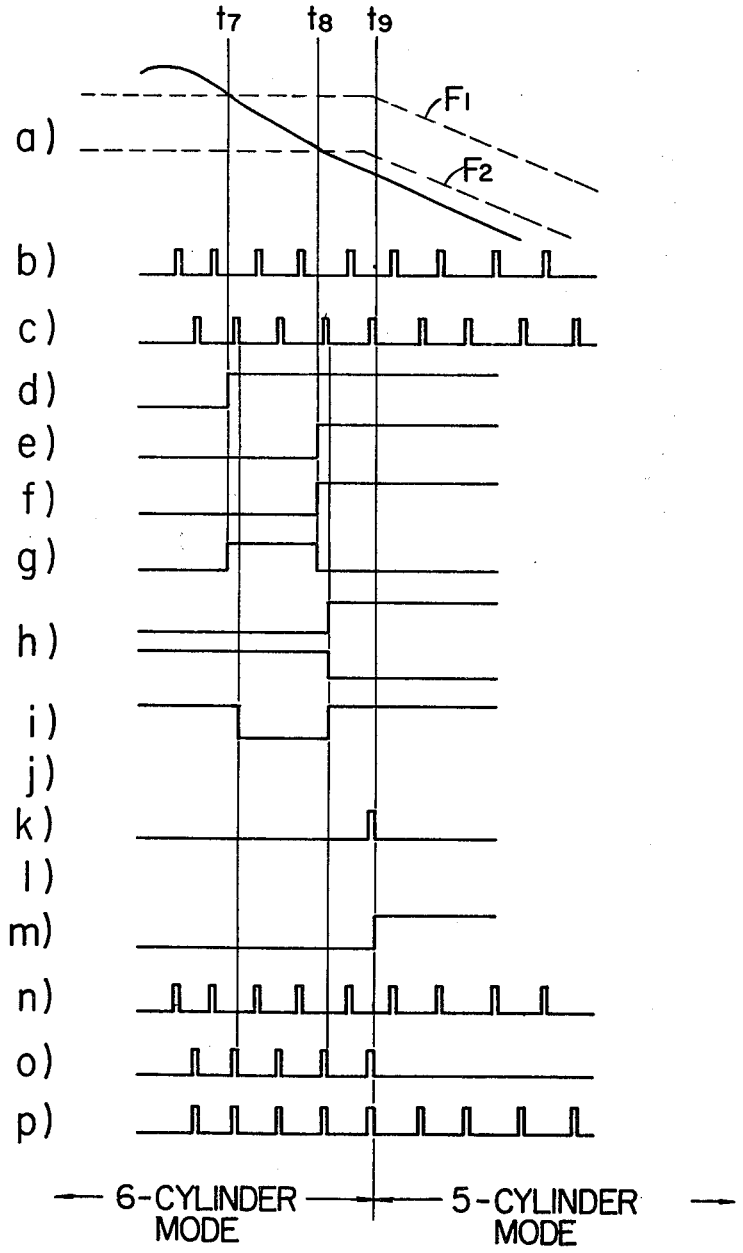

This condition continues until the time when the flip-flops 9 and 10 change their stable states as at time $t_2$ when the engine load falls below the setting level $F_2$ (FIG. 3). AND gate 30 is enabled by the "1" logic state of Q output of flip-flop 9 to pass clock pulses to the up-count input of the counter 32. In response to each of the applied clock pulses, the counter 32 is up-counted, and its binary output is decoded so that the output state of the leads $C_1$, $C_2$ and $C_3$ changes respectively in sequence "011", "101" and "110". Therefore, in response to the first clock or injection pulse subsequent to time $t_2$, the output states of the leads $C_1$, $C_2$ and $C_3$ assumes "0", "1" and "1", respectively. This combination of output states on leads $C_1$ to $C_3$ produces a low voltage level output or disabling signal at the output of AND gate 36 and the No. 4 cylinder is disabled while the remainder cylinders are enabled. in response to the second injection pulse, the output condition of the decoder 33 changes so that leads $C_1$ to $C_3$ asumme "1", "0" and "1" logic state respectively. This combination of output states produces disabling signals from the output of AND gates 35 and 39, disabling No. 1 and No. 6 cylinders. In response to the third injection pulse, leads $C_1$ to $C_3$ takes binary states "1", "1" and "0", respectively, to generate disabling signals from the AND gates 36, 37 and 39. Thus, No. 4, No. 5 and No. 6 cylinders are disabled.

Therefore, within the time interval $t_2$ to $t_4$ the number of active cylinders is successively decreased one at a time in step with subsequent injection pulses to a minimum number of three. It will be understood therefore that at time $t_5$, the number of active cylinders will increase successively on a one-at-a-time basis in response to each injection pulse at the same rate as when the number of cylinders is decreased successively as at time $t_2$.

Figure 5:
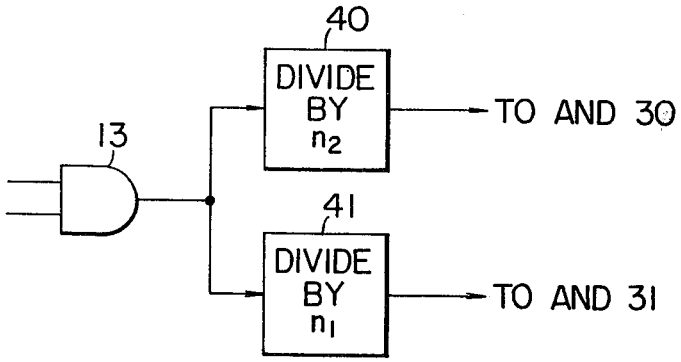
FIG. 5 is a modification of the embodiment of FIG. 4.

During acceleration it is advantageous to increase the number of active cylinders at a higher rate than the rate at which it is decreased successively during deceleration, since the higher rate increase serves to prevent deficient delivery of power for acceleration. FIG. 5 illustrates a circuit necessary for effecting such higher rate enabling control. The output from the AND gate 13 is coupled to counters 40 and 41. The counter 40 is designed to provide its output at each count of $N_1$ input pulses, while the counter 41 provides its output at each count of $N_2$ input pulses, where $N_2$ is smaller than $N_1$. The outputs from the counters 40 and 41 are connected to the AND gates 30 and 31 whose respective outputs are connected to the up- and down-count input terminals of the forward-backward counter 32 as previously described. AND gate 31 is thus arranged to receive input pulses which occur at shorter intervals than the pulses applied to the AND gate 30 so that the forward-backward counter 32 is down counted at a higher rate than it is up counted.

What is claimed is:

1. A method for operating a multi-cylinder internal combustion engine on a varying number of its cylinders as a function of an operating parameter of said engine, comprising establishing a high reference variable as a function of the engine revolution per unit time and a low reference level variable as a function of the engine revolution per unit time, increasing the number of working cylinders when the engine load is above said higher reference level, decreasing the number of working cylinders when the engine load is below said lower reference level, and maintaining the number of said working cylinders when the engine load lies between said high and low reference levels.

2. Apparatus for operating a multi-cylinder internal combustion engine on a varying number of cylinders as a function of an operating parameter of the engine, comprising:

means for detecting an operating parameter of said engine representative of the load on said engine;

means for detecting the revolution per unit time of said engine;

means for setting a high reference level variable as a function of the detected engine revolution;

means for setting a lower reference level variable as a function of the detected engine revolution; and injection control circuit means including means for increasing the number of active cylinders when the detected engine load is above said higher reference level, means for decreasing the number of active cylinders when the detected engine load is below said lower reference level, and means for maintaining the number of active cylinders when the detected engine load lies between said high and low reference levels.

3. Apparatus as claimed in claim 2, wherein said injection control circuit means comprises means for comparing the detected engine load with said high and low reference levels to generate a first signal indicating that the engine load is above said higher reference level, a second signal indicating that the engine load is below said lower reference level and a third signal indicating that the engine load is between said high and low reference levels, and a logic gate circuit for enabling part of said cylinders to increase power in response to said first signal, disabling part of said cylinders to decrease power in response to said second signal, and maintaining the number of working cylinders in the presence of said third signal.

4. Apparatus as claimed in claim 3, wherein said internal combustion engine includes means for injecting fuel in response to electrical injection pulses, and wherein said injection control circuit comprises a pair of bistable devices operable to assume one of binary states in response to said injection pulse in the presence of one of said first, second and third signals, and a gate circuit for passing said injection pulses to a selected fuel injection unit in the presence of an output from said bistable devices.

5. Apparatus as claimed in claim 4, wherein said gate circuit includes a forward-backward counter for providing a variable count output representing the number of non-working cylinders in response to said injection pulse depending upon said output from said bistable devices.

6. Apparatus as claimed in claim 2, wherein said means for setting a high variable reference level comprises a function generator responsive to the detected engine revolution to generate an output which increases in proportion to engine speed for a certain range of lower engine speeds and maintains a constant value over the range of higher engine speeds, and wherein said means for setting a lower variable reference level comprises a second function generator responsive to the detected engine revolution to generate a second output which increases in proportion to the engine speed for a certain range of lower speeds and maintains a constant value over the range of higher engine speeds, there being a difference of constant value between the first-mentioned output and said second output.

* * * * *